United States Patent [19]

Gaskell

[11] 4,356,946

[45] Nov. 2, 1982

[54] CONSTANT CONVEYOR WEB OUTPUT VELOCITY COMPENSATOR FOR VARIABLE INPUT WEB VELOCITIES

[75] Inventor: Alfred J. Gaskell, Hopkins, Minn.

[73] Assignee: Pako Corporation, Minneapolis, Minn.

[21] Appl. No.: 197,829

[22] Filed: Oct. 17, 1980

Related U.S. Application Data

[63] Continuation of Ser. No. 809,551, Jun. 24, 1977, abandoned.

[51] Int. Cl.[3] ..... B65H 17/42

[52] U.S. Cl. ..... 226/117; 226/119

[58] Field of Search ..... 226/113, 114, 118, 119, 226/178, 25, 42, 43, 109, 117, 170

[56] References Cited

U.S. PATENT DOCUMENTS

| | | | |
|---|---|---|---|
| 2,059,979 | 11/1936 | Aiken | 226/119 |
| 3,380,678 | 4/1968 | Feasey | 226/254 U |
| 3,942,190 | 3/1976 | Detwiler | 226/113 X |
| 4,009,814 | 3/1977 | Singh | 226/113 |

*Primary Examiner*—Edward J. McCarthy

*Attorney, Agent, or Firm*—Kinney, Lange, Braddock, Westman and Fairbairn

[57] ABSTRACT

A compensator which permits the input velocity of a web conveyor system to be varied (reduced to zero if desired) while maintaining a constant output velocity and tension in the web. This is accomplished by a power actuated movable carriage having web rollers connected therewith for controllably varying the length of a multiple run web control path interposed at the input end of a belt conveyor system.

9 Claims, 4 Drawing Figures

CONSTANT CONVEYOR WEB OUTPUT VELOCITY COMPENSATOR FOR VARIABLE INPUT WEB VELOCITIES

This is a continuation, of application Ser. No. 809,551, filed June 24, 1977, abandoned.

The prior art known to the applicant at this time constitutes a series of counterbalanced festoon idler rollers arranged to provide a take-up web path which permits stopping of the input end of the take-up festoons by shortening the festoons in response to increased tension in the web portions which form the festoon lengths. This increased tension at the output end of the take-up web path results in increased tension throughout the length of the conveyor web which causes undesirable variations in the velocity and length of the web.

The present invention provides a power driven compensator mechanism specifically designed to maintain constant tension as well as velocity throughout the entire length of the conveyor web even during the time interval when the input end is being held at zero velocity to facilitate attaching separate strips thereto.

More specifically, by providing a power actuated carriage on which certain of the festoon defining rollers are mounted, the length of the festoons or web runs can be positively and accurately varied to provide an input velocity control mechanism for a predetermined period of time and permit zero velocity (if desired) to be temporarily maintained at said input end.

The following is a description of the specific embodiment of this invention illustrated in the accompanying drawings wherein like reference characters refer to similar parts throughout the several views and in which.

Figure 4:
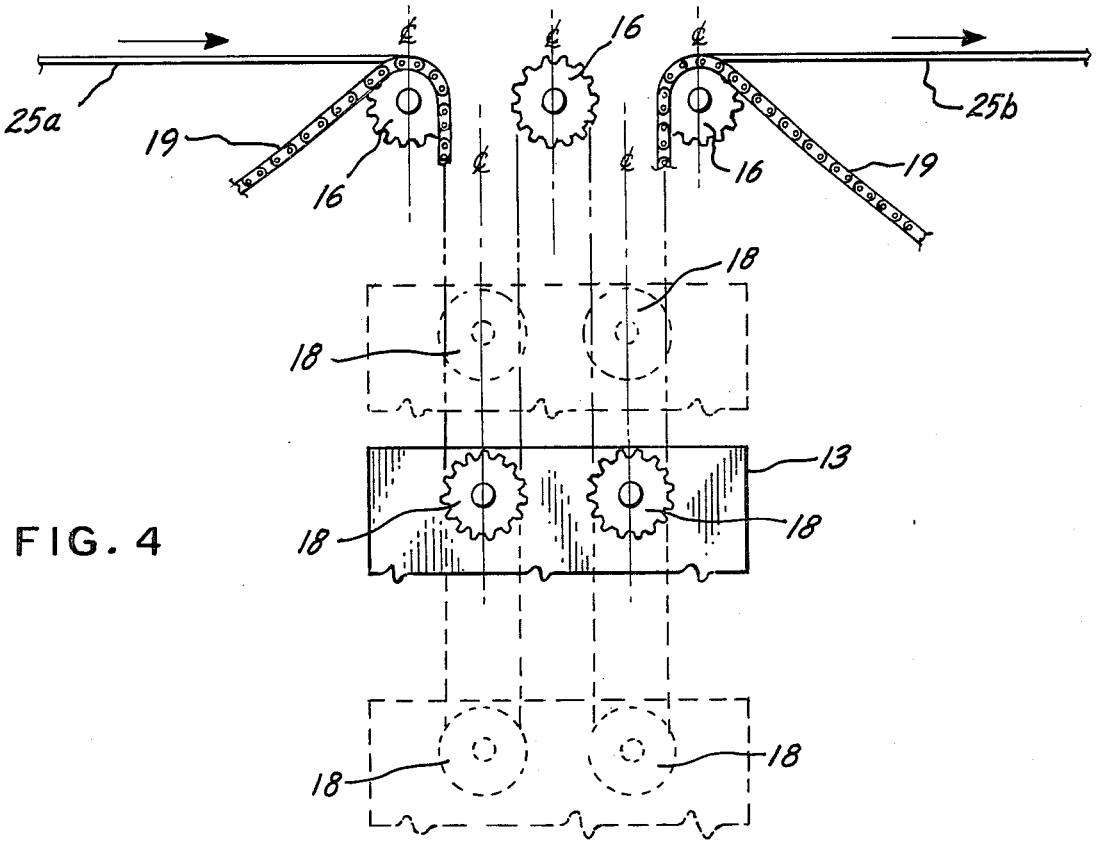

FIG. 4 schematically illustrates another embodiment of the present invention.

Figure 2:
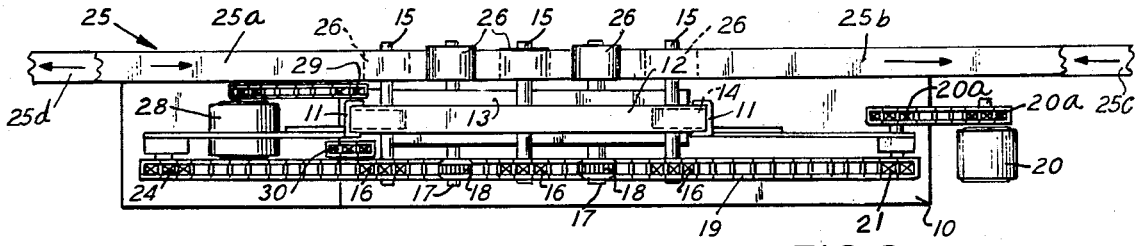
FIG. 2 is a top plan view thereof.

As shown in the drawings, I provide a supporting structure having a base 10 and a pair of upright track members 11 rigidly tied together at their upper ends by a cross member 12. An elevator or movable carriage 13, having a plurality of guide wheels 14, is mounted for up and down vertical movement on upright track members 11, which are in the form of channel members, as best shown in FIG. 2.

A plurality of upper shafts 15 are rotatably journaled on the fixed cross member 12 and have suitable driving means fixed thereto such as the sprockets 16 illustrated. A set of shafts 17 are journaled in the upper portion of the carriage 13 and have a second set of driving sprockets 18 mounted thereon. An endless drive chain 19 is trained about the sprockets 16 and 18 for driving the same at a constant predetermined speed. A suitable source of driving power is provided, such as the electric motor 20, having a chain and sprocket driving connection 20*a* which is connected with a chain driving sprocket 21 meshed with chain 19. Suitable idler sprockets 22 are journaled in the lower portion of the base frame 10 and a pair of carriage mounted sprockets 23 are journaled in the lower portion of the carriage 13 as illustrated. Suitable idler sprockets 24 are journaled on suitable supporting frame elements to define the path of the chain 19 on the supporting frame structure.

Figure 3:
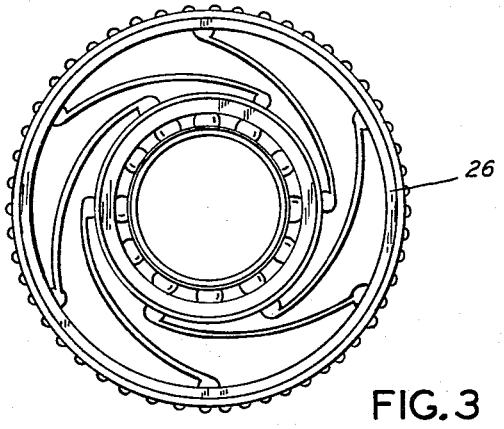
FIG. 3 is a side elevational view of a typical spring spool unit.

A transport web or conveyor belt 25 for a processor such as a photographic processor (not shown), is provided with an input portion 25*a*, an output portion 25*b* and return portions 25*c* and 25*d*. The web is trained about suitable velocity control rollers, such as the spring spool type rollers 26 best shown in FIG. 3 of the drawings and disclosed in Jensen U.S. Pat. No. 3,369,765 assigned to Eastman Kodak Co., Rochester, New York. The portion of the web 25 between the input and output portions 25*a* and 25*b* thereof are controlled by the operation of the carriage 13 and form a web control path.

Suitable means for moving the carriage or elevator 13 up and down on the track members 11 is provided, such as the chain 27, one end of which is connected to the bottom of the carriage 13 as indicated at 27*a* and the other end of which is connected to the top of the carriage at 27*b*. An electric motor 28 provides the driving power to the chain 27 through a suitable chain and sprocket drive 29 which includes a driving sprocket 29*a* meshed with chain 27. An idler sprocket 30 is mounted on the upper portion of the frame structure and has the chain 27 trained therearound. Idler belt rollers are freely journaled on shafts 17 at the upper portion of the carriage 13 and a similar set of idler rollers are freely journaled on the bottom shafts on which the bottom idler sprockets 22 are mounted.

The function of the transport web 25 is to carry items through a processor such as a photographic film processor (not shown). A constant web velocity through the processor is required; however, the input end 25*a* must be stopped periodically to facilitate attachment of items such as strips of photographic paper to said web 25 at the input end of the processor.

OPERATION

When the belt or web 25 is to be stopped at the input end 25*a* thereof the operator presses a control button (not shown) to start the motor 28 which drives the chain 27 in a counter clockwise direction to raise the carriage 13 at a predetermined velocity which is ½ of the output velocity of the web portion 25*a*. When the carriage 13 is moved upwardly on its track, the length of the take-up portion of the belt 25 disposed between the roller 26 at the input end and the roller 26 at the output end of the compensator mechanism, will be shortened at twice the velocity at which the carriage 13 is being raised so that the input portion 25*a* of the belt will be stopped if the upward speed of the carriage 13 is ½ the output velocity of the belt at 25*b*. The endless drive chain 19 provides driving power for the upper demand driven rollers 26 through the sprockets 16 and drive shafts 15 (respectively connected therewith) so that a substantially constant tension and velocity are maintained in the belt 25 at its output end 25*b*. Similar spring spool rollers 26 are mounted on the lower portion of the carriage and are driven by chain 19 and sprocket wheels 23 to maintain the velocity and tension in the lower portions of the belt 25*c* and 25*d* as shown. The effective driving diameter of the sprockets 16 and 23 must be at least as large as the effective diameter of the spools 26 being driven thereby. If said diameters are the same, the speed at which the chain is driven by drive motor 20 will be the same as the speed at which the belt is to be driven. If the sprockets 16 and 23 were smaller than the rollers 23 and the chain driven at a proportionally slower speed, there would be an "overdrive effect" produced by the belt 25 on the chain when the carriage 13 is being raised. For example, if the sprockets were half the diameter of the rollers 26 and the chain were being driven at 10 feet per minute, the velocity of the belt 25 would be 20 feet per minute. If the carriage 13 were then raised at the rate of 10 feet per minute, the input portion of the belt would be effectively stopped. This condition would produce slack in the take-up portion of the chain. When the diameter of the sprocket 16 is the same as the diameter of the rollers 26 being driven thereby, the velocity of the chain 19 would then be driven at the same speed as the output velocity of the belt and the input ends of the chain and the belt may be effectively stopped by raising the elevator 13 at ½ the linear speed of the belt and chain. After attachment of the strips to the input portion 25*a* of the web 25, the operator pushes another button (not shown) to reverse the motor 28 in a conventional manner and return the carriage 13 to its lower most rest position, as shown by lower dotted lines in FIG. 1. During the return of the carriage to rest position, the input velocity of belt portion 25*a* will be increased to twice the downward return velocity of the carriage 13.

Figure 1:
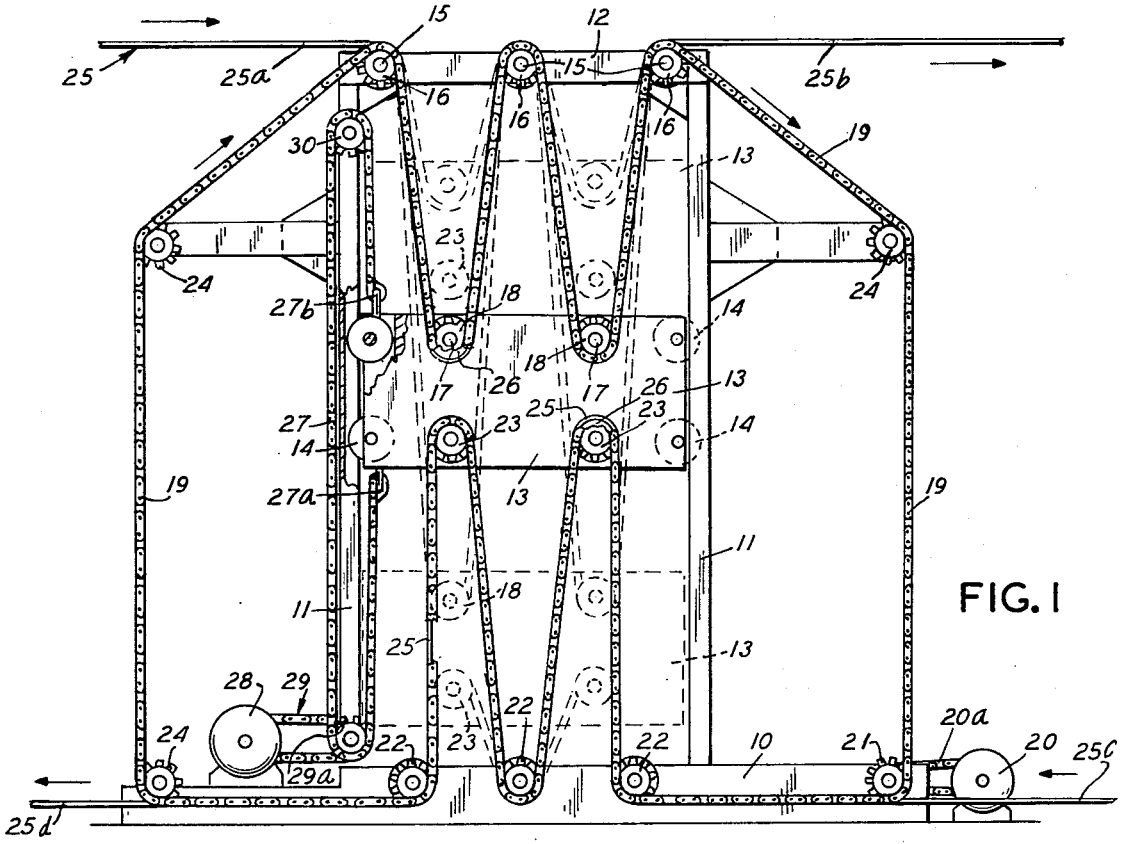
FIG. 1 is a front elevational view of a speed and tension compensating device embodying this invention.

As pictured in FIG. 1, the chains and transfer belts running between the main frame and the carriage are not parallel due to the spacing of the axes of the sprockets. With the chains and belts being non-parallel, as the carriage moves the rate of velocity change of the belts will not be uniform throughout the path of travel of the carriage. These variations are slight, however, and are compensated for by the spring spool demand drive servo roller drive mechanism shown in FIG. 3.

FIG. 4 schematically illustrates an alternative embodiment of the present invention which uses sprockets and belt pulleys which are all of identical size and spaced on center lines with are one diameter apart. Although only sprockets 16 and 18 are shown in FIG. 4, it will be clear that sprockets 22 and 23 are similarly arranged. In this embodiment, the portions of chain 19 and belt 25 between the sprockets and pulleys remain parallel regardless of the position of carriage 13, and as carriage 13 moves up and down the rate of change of the velocity is uniform (i.e. follows a straight line relationship); and, therefore, compensation by the spring spool servo rollers is not required.

It will be seen that this invention provides a conveyor feeding mechanism particularly adapted for use with a film processing machine and having a power actuated velocity compensation device which, upon actuation, automatically controls the web velocity at the input end of the feeding mechanism while maintaining uniform tension and uniform output velocity during which time an operator is permitted to perform an operation on the strip of material being conveyed at said controlled input end of the compensating device such as attaching the strip to the transport web 25.

It will be understood, of course, that various changes may be made in the form, details, arrangement and proportions of the parts without departing from the scope of this invention, which generally stated is set forth in the appended claims.

What is claimed is:

1. A controllable input speed, constant tension and constant output speed comparator for a web conveyor system comprising:

a plurality of spaced apart rollers defining a back and forth input speed control path, a web trained about said rollers and following the control path and providing a speed control takeup length, power actuated means for controllably varying the length of the control path to control the input speed of a strip entering the control path while maintaining a constant web output speed and driving means for imparting driving power to a set of rollers of the plurality to maintain a predetermined output velocity in the web and each of the rollers in the set of rollers having a spring spool demand driven roller for transmitting driving power from the driving means to the rollers.

2. The structure set forth in claim 1 wherein the driving means include a chain and sprocked drive with certain of the sprockets having driving connection with the rollers of the set.

3. The structure set forth in claim 2 and the effective diameter of the sprockets of the chain and sprocket drive being at least as large as the effective diameter of the rollers of the set.

4. The structure set forth in claim 1 wherein the control path has non-parallel portions between the spaced apart rollers whose angular relationship varies with changes in the length of the control path.

5. The structure set forth in claim 1 wherein the control path has substantially parallel portions between the spaced apart rollers.

6. A power-driven speed compensator for a web conveyor system to control the web input speed while the web is in motion traveling through the web path of the conveyor system and while maintaining a constant tension and constant output speed of a web for a limited time interval, said compensator comprising:

a pair of generally opposed spaced apart sets of web-engaging rollers for providing a velocity compensating control path having a plurality of doubled back and forth web runs, first power means for driving said rollers, a web trained about the rollers and following the control path defined thereby, and second power means for controllably increasing and decreasing the spacing between the respective sets of rollers to positively control the length of the control path to produce a constant velocity output for a limited time period, while controllably varying the input velocity during the operation of the first power means and transportation of the web through the control path.

7. The structure set forth in claim 6 wherein the doubled back and forth web runs are substantially parallel.

8. The structure set forth in claim 6 wherein the doubled back and forth web runs are non-parallel and change their angular relationship with changes in spacing between the respective sets of rollers, and wherein the structure further comprises demand driven speed compensating belt rollers for compensating for variations in rate of velocity change of the web as the spacing between respective sets of rollers is changed.

9. The structure set forth in claim 8 and an intermediate carriage mounted for back and forth reciprocation and carrying on one side thereof one of the sets of rollers of the first pair, a second pair of generally opposed spaced apart sets of web engaging rollers for providing a compensating takeup path having a plurality of back and forth web runs, one set of said second pair being carried by said carriage, said second power means controllably moving said carriage to increase the length of one web path while simultaneously decreasing the length of the other web path.

* * * * *